US008657006B2

(12) United States Patent
Mire

(10) Patent No.: US 8,657,006 B2
(45) **Date of Patent: *Feb. 25, 2014**

(54) OIL WELL PLUG AND ABANDONMENT METHOD

(71) Applicant: Gulfstream Services, Inc., Houma, LA (US)

(72) Inventor: Michael Mire, Houma, LA (US)

(73) Assignee: Gulfstream Services, Inc., Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/658,612

(22) Filed: Oct. 23, 2012

(65) Prior Publication Data

US 2013/0140026 A1 Jun. 6, 2013

Related U.S. Application Data

(63) Continuation of application No. 12/463,996, filed on May 11, 2009, now Pat. No. 8,291,977.

(60) Provisional application No. 61/059,127, filed on Jun. 5, 2008, provisional application No. 61/051,962, filed on May 9, 2008.

(51) Int. Cl.
*E21B 29/00* (2006.01)

(52) U.S. Cl.
USPC ..... 166/298; 166/55.2; 166/85.1; 166/377

(58) Field of Classification Search
USPC ..... 166/55, 55.2, 297, 298, 85.1
See application file for complete search history.

(56) References Cited

U.S. PATENT DOCUMENTS

| | | | |
|---|---|---|---|
| 3,766,985 | A | 10/1973 | Willhite |
| 3,828,852 | A | 8/1974 | Delano |
| 4,043,389 | A | 8/1977 | Cobb |
| 4,345,651 | A | 8/1982 | Akkerman et al. |
| 4,427,065 | A | 1/1984 | Watson |
| 4,624,312 | A | 11/1986 | McMullin |
| 4,671,353 | A | 6/1987 | Daming |
| 4,674,573 | A | 6/1987 | Bode |
| 4,722,389 | A | 2/1988 | Arnold |
| 4,782,894 | A | 11/1988 | LaFleur |
| 4,854,383 | A | 8/1989 | Arnold et al. |
| 4,886,121 | A | 12/1989 | Demny et al. |
| 4,979,489 | A | 12/1990 | Abbasov et al. |
| 4,995,457 | A | 2/1991 | Baldridge |
| 5,060,542 | A | 10/1991 | Hauk |
| 5,095,988 | A | 3/1992 | Bode |

(Continued)

FOREIGN PATENT DOCUMENTS

JP 2003214078 A 7/2003

*Primary Examiner* — Giovanna Wright
(74) *Attorney, Agent, or Firm* — Garvey, Smith, Nehrbass & North, L.L.C.; Charles C. Garvey, Jr.; Vanessa M. D'Souza

(57) ABSTRACT

A method of severing a well string that extends into an oil well from an oil platform with a deck includes supporting upper and lower sections of the well string, the lower section supported at the platform deck with a deck located string support. A shear mechanism cuts the well string at a position that can be above the deck located string support. The upper section is then lifted a selected distance and the deck located string support again supports the string at a position below the cut.

19 Claims, 12 Drawing Sheets

(56) References Cited

U.S. PATENT DOCUMENTS

| | | | | |
|---|---|---|---|---|
| 5,139,006 | A | 8/1992 | Trudeau | |
| 5,236,035 | A | 8/1993 | Brisco et al. | |
| 5,245,982 | A | 9/1993 | Trudeau | |
| 5,293,933 | A | 3/1994 | Brisco | |
| 5,386,746 | A | 2/1995 | Hauk | |
| 5,413,086 | A | 5/1995 | Trudeau | |
| 5,435,390 | A | 7/1995 | Baugh et al. | |
| 5,443,122 | A | 8/1995 | Brisco | |
| 5,676,492 | A | 10/1997 | Van Steijn | |
| 5,758,726 | A | 6/1998 | Streich et al. | |
| 5,833,002 | A | 11/1998 | Holcombe | |
| 5,856,790 | A | 1/1999 | Baugh et al. | |
| 5,960,881 | A | 10/1999 | Allamon et al. | |
| 6,142,226 | A | 11/2000 | Vick | |
| 6,182,752 | B1 | 2/2001 | Smith, Jr. et al. | |
| 6,390,200 | B1 | 5/2002 | Allamon et al. | |
| 6,575,238 | B1 | 6/2003 | Yokley | |
| 6,672,384 | B2 | 1/2004 | Pedersen et al. | |
| 6,715,541 | B2 | 4/2004 | Pedersen et al. | |
| 6,827,145 | B2 | 12/2004 | Fotland et al. | |
| 6,904,970 | B2 | 6/2005 | Simson | |
| 7,021,381 | B1 | 4/2006 | Remedies et al. | |
| 7,055,611 | B2 | 6/2006 | Pedersen et al. | |
| 7,055,632 | B2 | 6/2006 | Dallas | |
| 7,066,249 | B2 | 6/2006 | Simson | |
| 7,156,170 | B2 | 1/2007 | Fotland et al. | |
| 7,225,873 | B2 | 6/2007 | Schlegelmilch et al. | |
| 7,243,646 | B2 | 7/2007 | Todack | |
| 7,527,100 | B2 | 5/2009 | Abadie | |
| 7,607,481 | B2 | 10/2009 | Barbee | |
| 7,645,093 | B1 | 1/2010 | Clark et al. | |
| 8,291,977 | B2 * | 10/2012 | Mire | 166/298 |
| 2005/0082063 | A1 | 4/2005 | Fotland et al. | |
| 2008/0105436 | A1 | 5/2008 | Molina et al. | |

* cited by examiner

OIL WELL PLUG AND ABANDONMENT METHOD

CROSS-REFERENCE TO RELATED APPLICATIONS

This is a continuation of U.S. patent application Ser. No. 12/463,996, filed 11 May 2009 (issuing as U.S. Pat. No. 8,291,977 on 23 Oct. 2012, and published as US2009/0277637 on 12 Nov. 2009), which is a nonprovisional of U.S. Provisional Patent Application Ser. No. 61/051,962, filed 9 May 2008, and U.S. Provisional Patent Application Ser. No. 61/059,127, filed 5 Jun. 2008, all of which are hereby incorporated herein by reference.

Priority of U.S. patent application Ser. No. 12/463,996, filed 11 May 2009, U.S. Provisional Patent Application Ser. No. 61/051,962, filed 9 May 2008, and U.S. Provisional Patent Application Ser. No. 61/059,127, filed 5 Jun. 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to oil well plug and abandonment operations. More particularly, the present invention relates to an improved method wherein strings of tubular members such as production tubing, casing and the like are pulled from the well bore a length at a time, wherein at least some of the tubular members are concentric sections with concrete therebetween and wherein a single shearing cut is made through multiple of the concentric layers and the concrete using a pair of opposed blades that shear the concentric layers and the concrete.

2. General Background of the Invention

Presently, plug and abandonment of an oil well utilizes cold cutting of the sections of tubulars as they are removed from the well. This cold cutting is done with a saw. Coal cutting is very time consuming. It can be complicated if layers of concrete are provided in addition to multiple layers of tubular members such as multiple layers of casing. Concrete or cement must be manually removed by hammer and/or chisel.

Another method of cutting tubulars that are being removed from an oil well is to manually cut with a cutting torch. However, such use of cutting torches can generate injury or death if a pocket of natural gas is trapped in between layers of casing or tubing. Such a pocket of gas can be ignited by the open flame of a cutting torch generating an explosion.

The cutting and removal of sections of tubular production pipe, production casing or the like from an oil well is thus a time consuming and potentially hazardous activity.

BRIEF SUMMARY OF THE INVENTION

The present invention provides an improved method of severing oil well strings of production tubing and/or casing in a well abandonment operation, especially effective when multiple concentric layers of casing and/or concrete (or cement) are part of the tubular string.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 5:
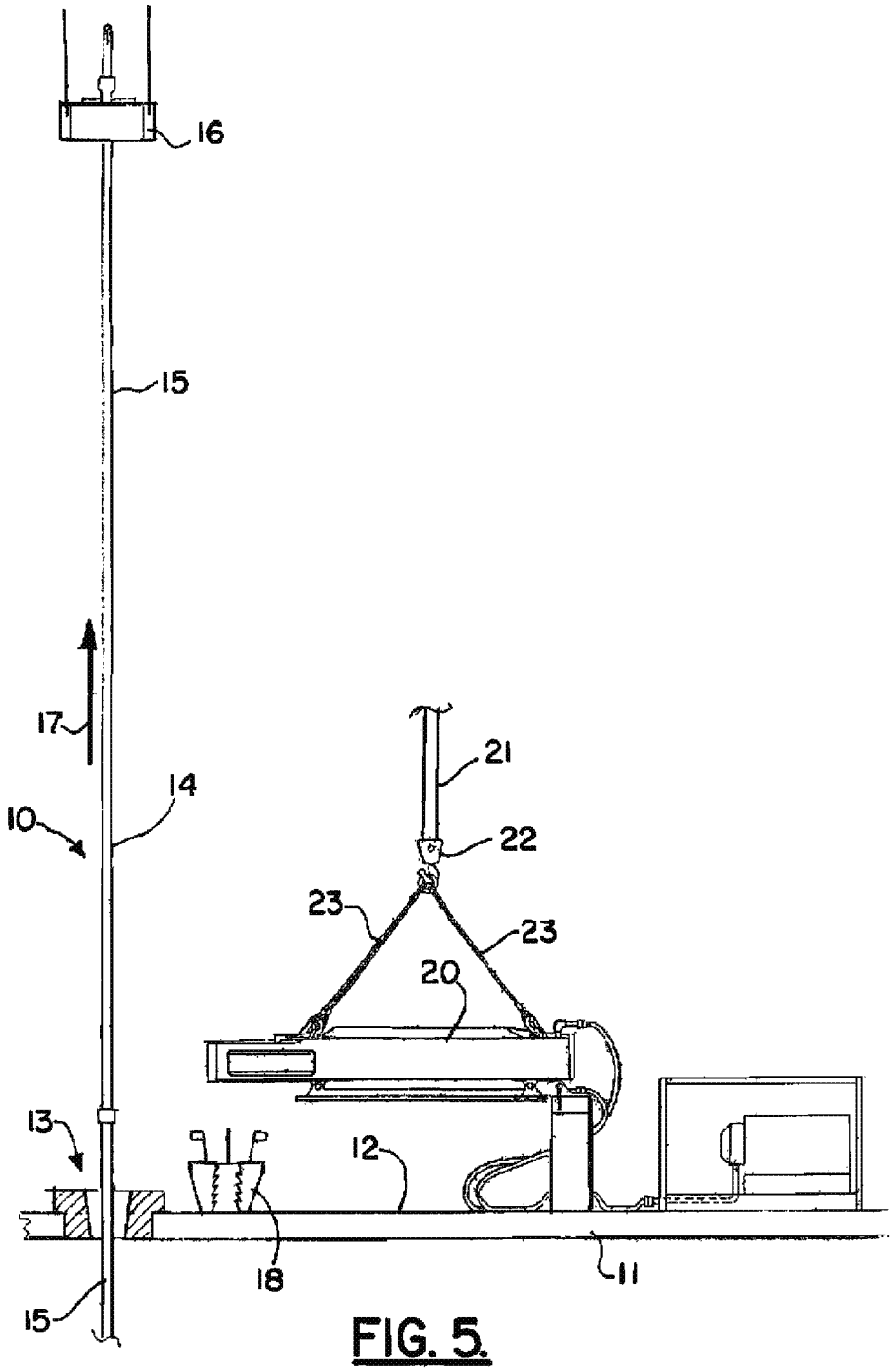
FIG. 5 is an elevation view illustrating the method of the present invention.
Figure 6:
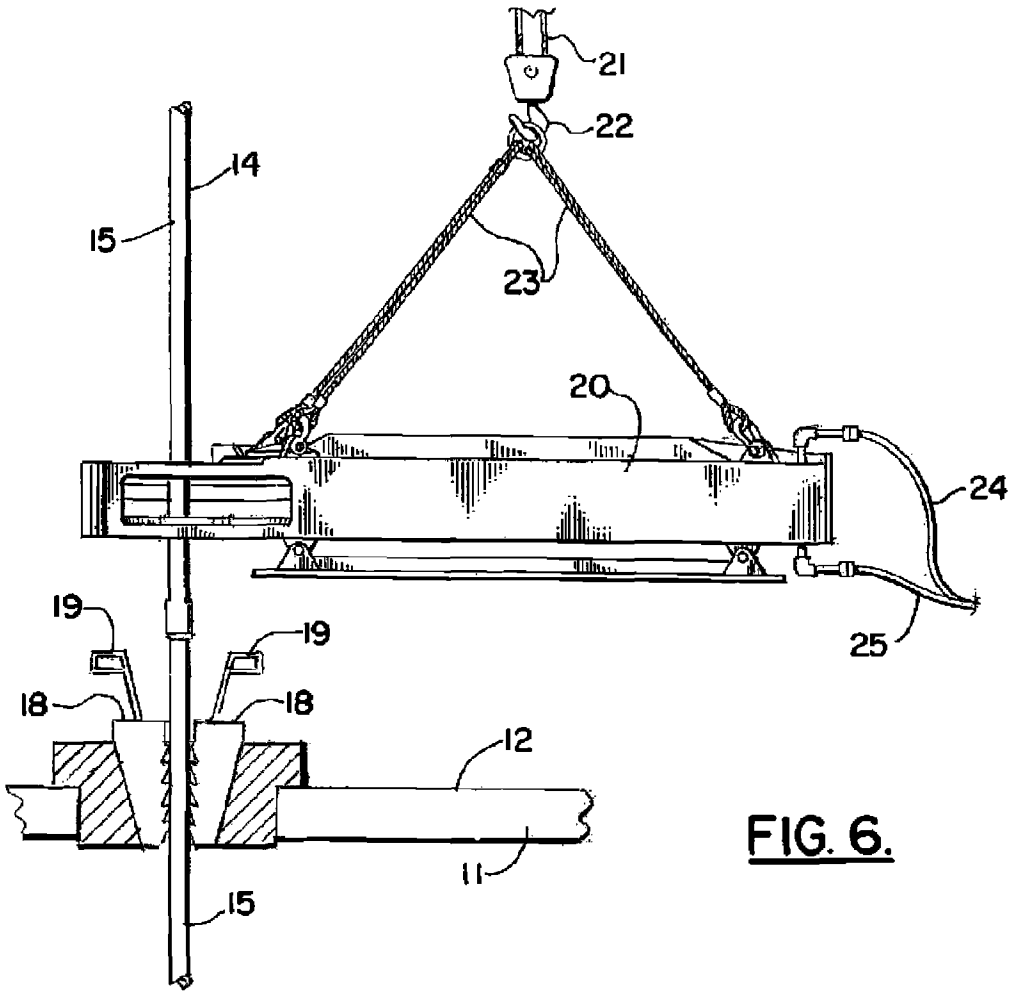
FIG. 6 is an elevation view illustrating the method of the present invention.

The present invention provides an improved plug and abandonment method for an oil well. In FIG. 5, an oil well is shown, designated generally by the numeral 10. Oil well 10 typically involves an oil platform 11 having a deck area 12 with an opening 13 through which tubular sections of material are inserted into the well. Such tubular members are connected end-to-end to form a string 14. The string 14 can be a string of production tubing 15 as shown in FIG. 5. In FIG. 5, a lifting device 16 pulls the pipe to be removed upwardly in the direction of arrow 17. Slips 18 can be used to hold the production pipe 15 or string 14 in a selected position as shown in FIG. 6. The slips 18 can be provided with handles 19 as is known.

Figure 7:
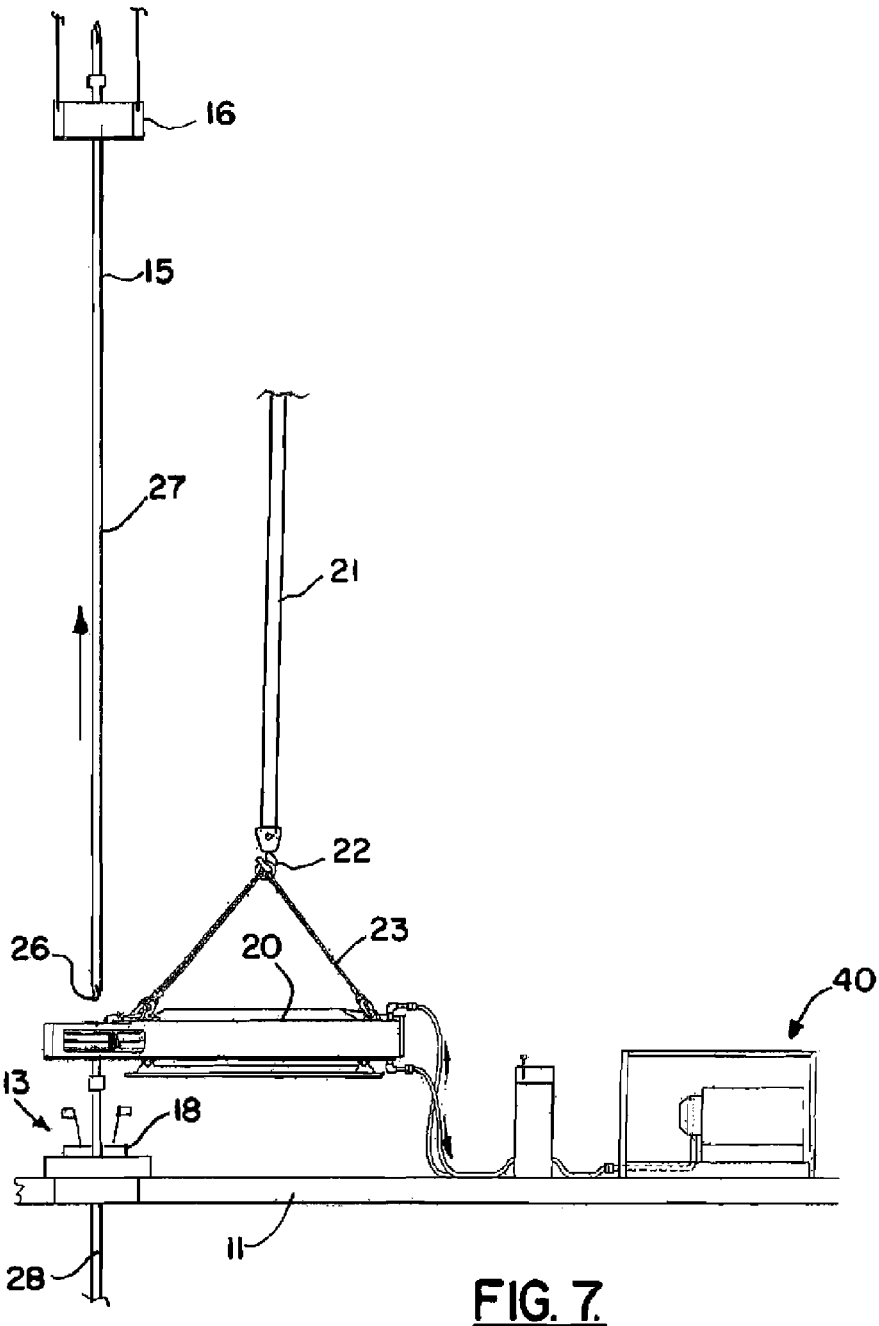
FIG. 7 is an elevation view illustrating the method of the present invention.

A shear mechanism 20 is hydraulically powered. The shear 20 can be supported with a lifting apparatus such as a crane having a lifting line 21, hook 22 and rigging 23. Hydraulic lines 24, 25 supply hydraulic fluid from hydraulic power unit 40 to the hydraulic cylinder or ram 47 of shear mechanism 20. In FIG. 7, a cut at 26 severs an upper part 27 of well string 14 or production tubing 15 from a lower part 28. The upper part 27 can be removed using the lifting device 16. The lower part 28 remains secured to the platform 11 using slips 18.

Figure 8:
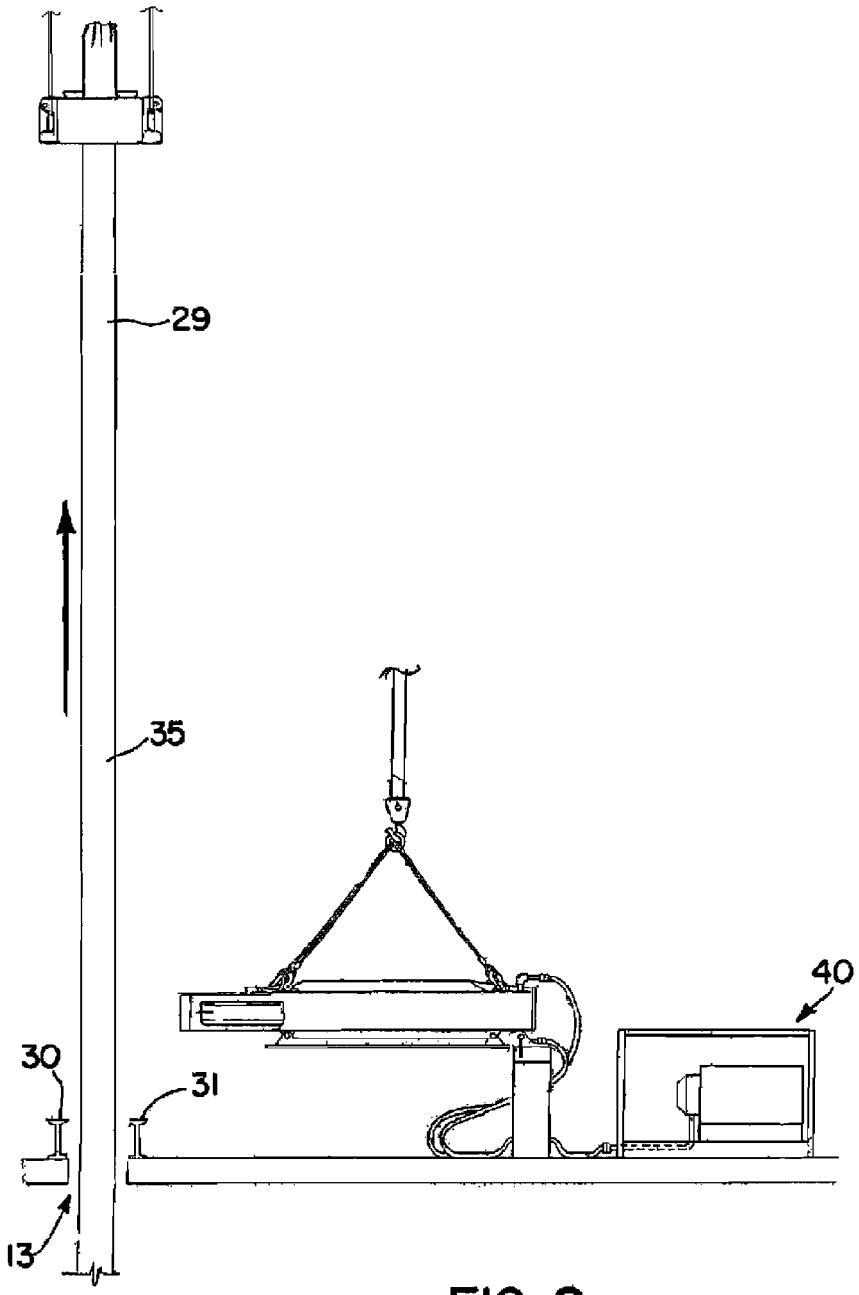
FIG. 8 is an elevation view illustrating the method of the present invention.
Figure 9:
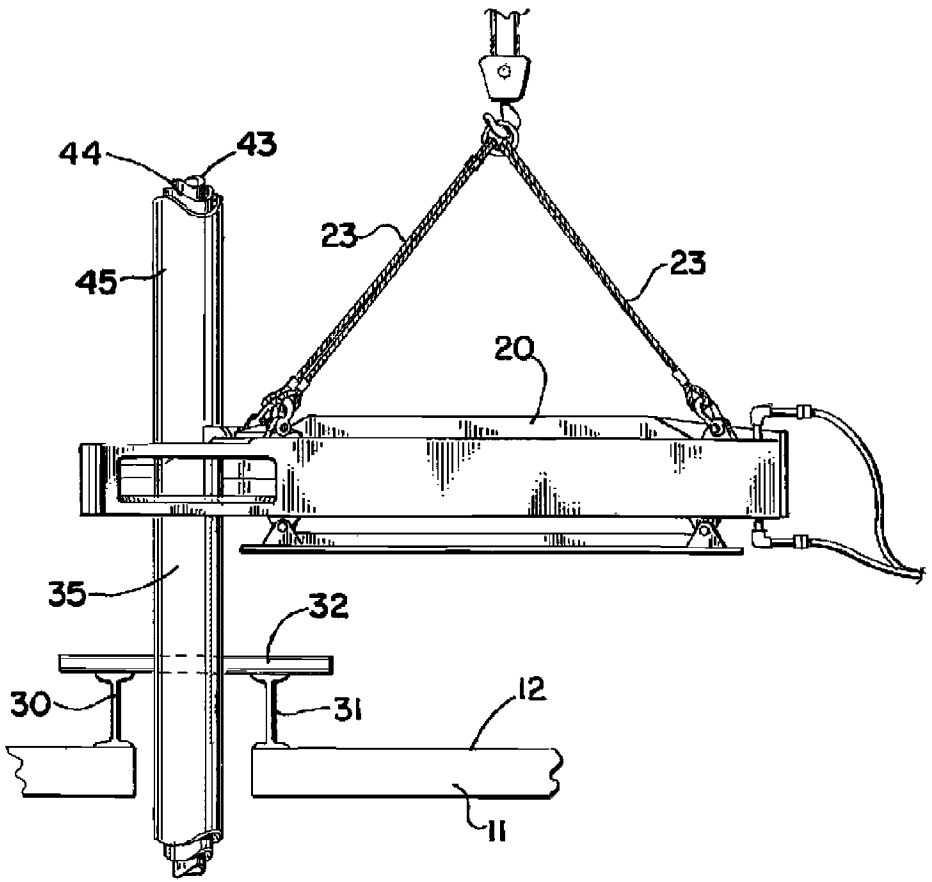
FIG. 9 is an elevation view illustrating the method of the present invention.
Figures 10, 11, 12:
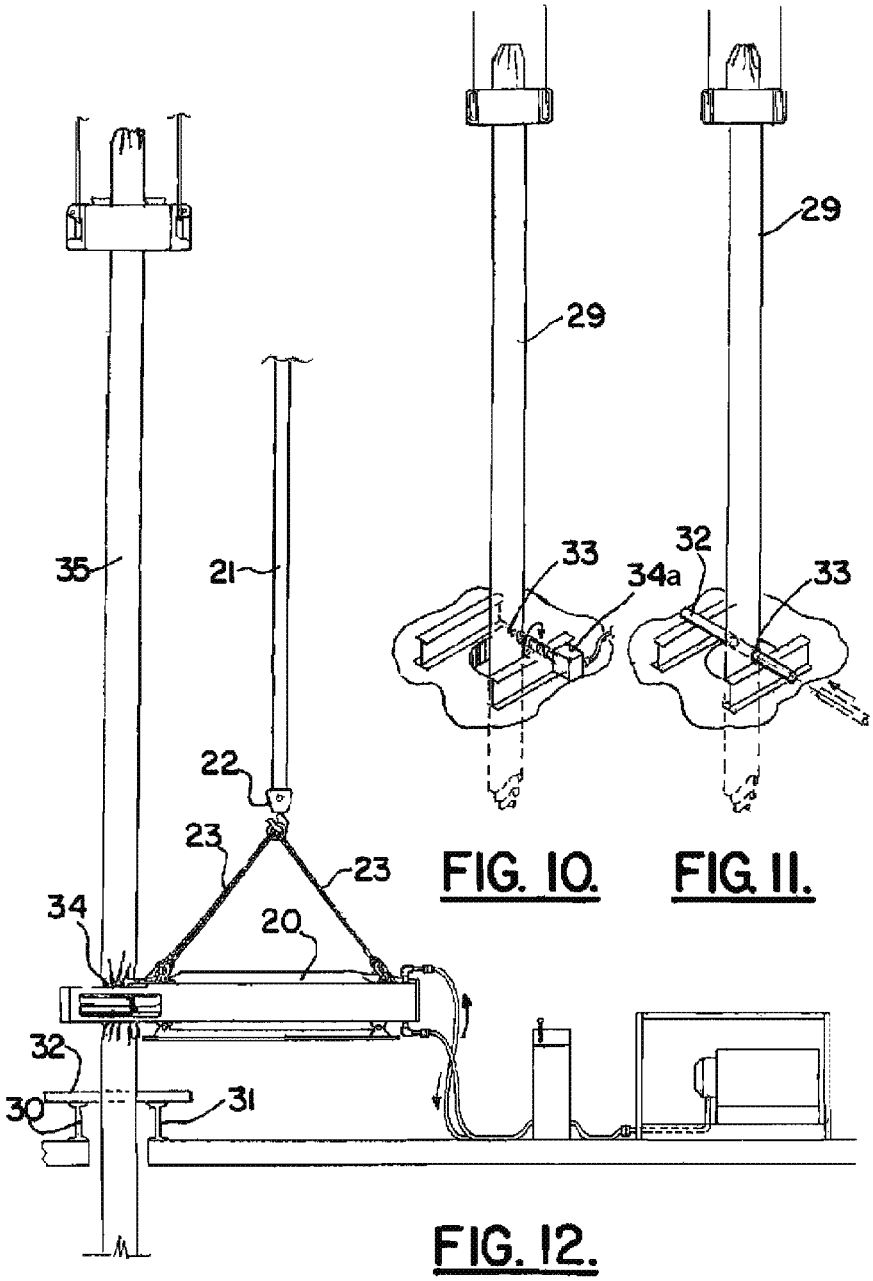
FIG. 10 is an elevation view illustrating the method of the present invention.
FIG. 11 is an elevation view illustrating the method of the present invention.
FIG. 12 is an elevation view illustrating the method of the present invention.
Figure 13:
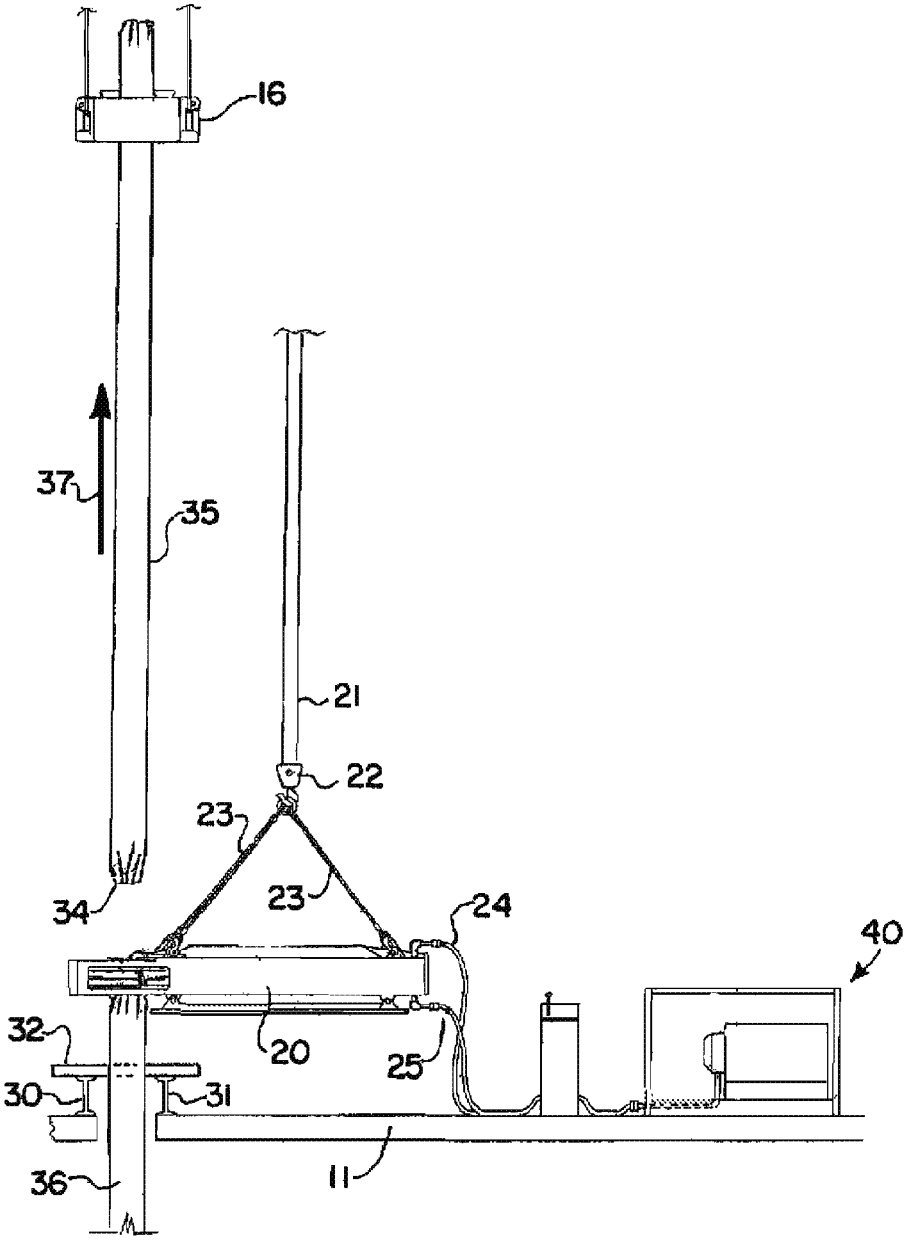
FIG. 13 is an elevation view illustrating the method of the present invention.

FIG. 8 illustrates a severing of a section of casing 29. Beams are placed at 30, 31 on opposing sides of opening 13 as shown in FIG. 8. In FIGS. 10 and 11, a drill 34*a* can be provided for forming an opening through the casing string 29. FIG. 10 shows a drill 34*a* forming the drilled opening in casing string 29. Pin 32 is then placed through the drilled opening 33 as shown in FIGS. 11 and 12. Once the casing string 29 is supported with the pin 32 and beams 30, 31, the shear mechanism 20 performs a cut at 34 severing the casing string 29 into an upper section 35 and a lower section 36. The upper section 35 can be removed upwardly using lifting device 16 as indicated by arrow 37 in FIG. 13. The lower section 36 of casing string 29 remains secured using pin 32 and beams 30, 31.

Figure 14:
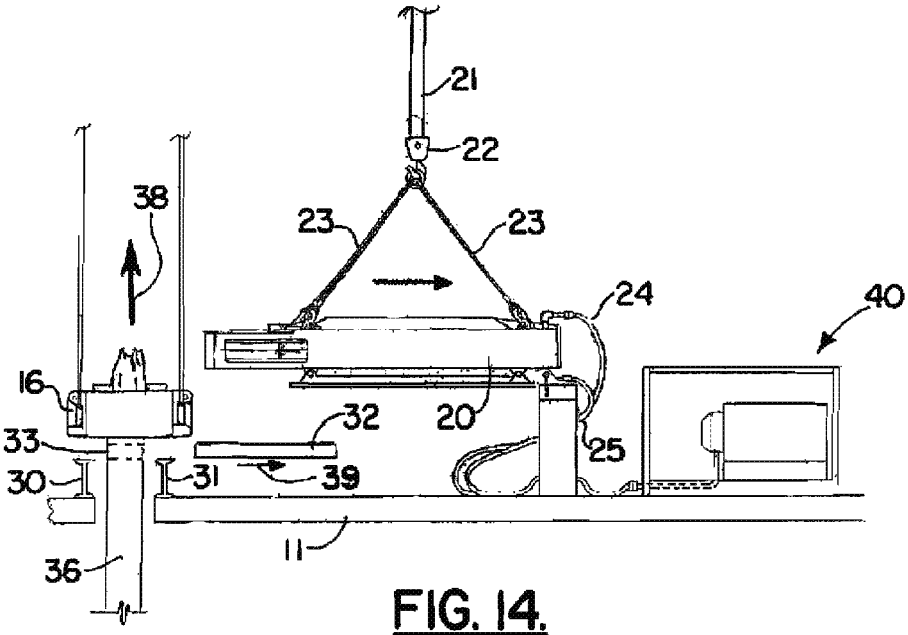
FIG. 14 is an elevation view illustrating the method of the present invention.

In FIG. 14, the lifting device 16 grabs the lower section 36 of casing string 29 and lifts it upwardly in the direction of arrow. Once the pin 32 has been lifted above beams 30, 31, the pin 32 can be removed from opening 33 as indicated by arrow 39 in FIG. 14.

Figure 15:
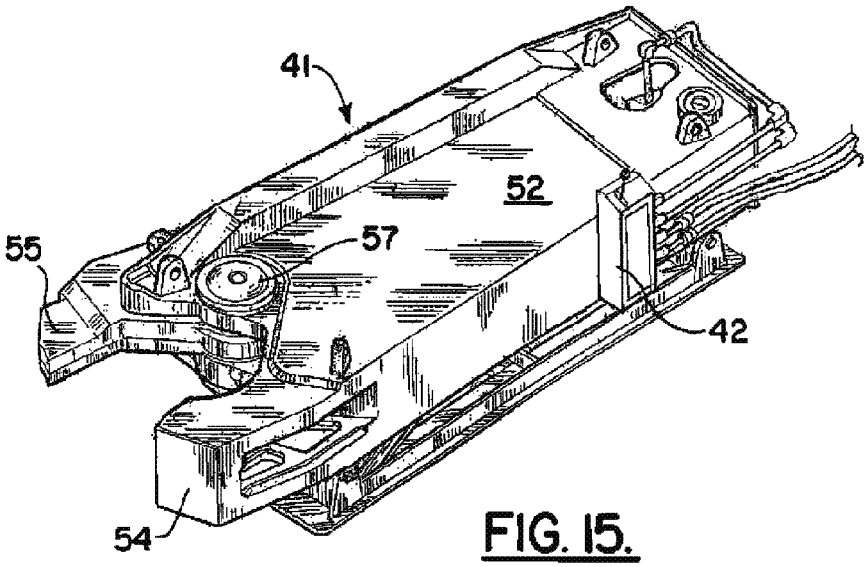
FIG. 15 is a fragmentary perspective view of the preferred embodiment of the apparatus of the present invention and illustrating a shear that is used with the method of the present invention.

In FIG. 15, a control panel 42 is attached directly to the shear mechanism 41. The control panel 42 can be used to control various functions of the shear mechanism such as for example opening and closing of the jaws 54, 55.

Figure 3:
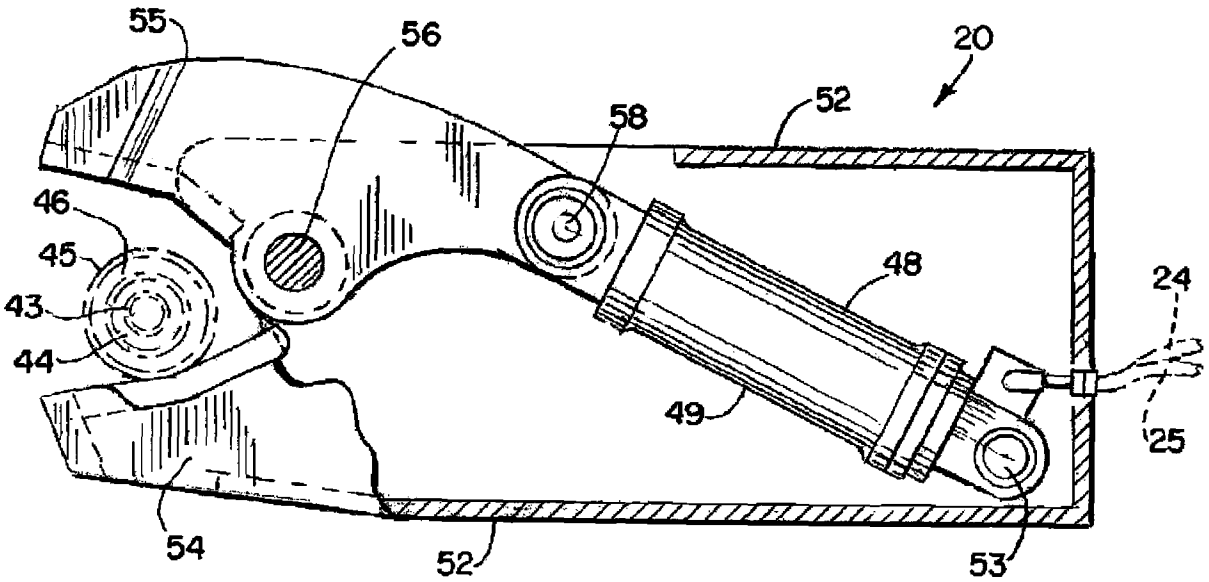
FIG. 3 is a top sectional view of the preferred embodiment of the apparatus of the present invention and showing a shear that is used with the method of the present invention.
Figure 4:
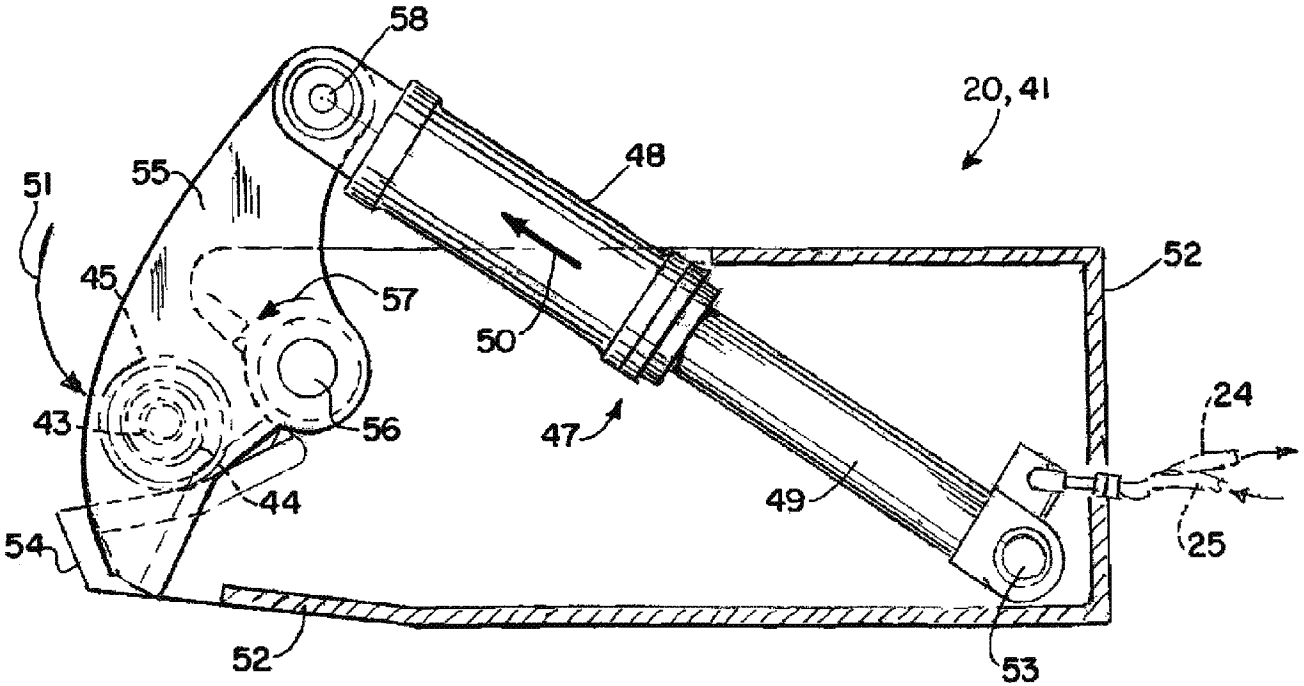
FIG. 4 is a top sectional view of the preferred embodiment of the apparatus of the present invention and showing a shear that is used with the method of the present invention, in a closed position.

FIGS. 3 and 4 illustrate the cut that is made through casing string 29. In many cases, the casing string can include concentric tubular members 43, 44, 45. Additionally, concrete or cement has been placed in between the layers 43, 44 or 44, 45 as indicated by the numeral 46 in FIG. 3. In FIG. 4, the shear mechanism 20 or 41 can be provided with a hydraulic ram 47 having a cylinder 48 and a pushrod 49. The ram 47 is extendable as indicated by arrow 50 in FIG. 4.

As the ram 47 is extended, moving jaw 55 rotates about pivot 56 relative to fixed jaw 54. A pinned connection at 58 can be used to join ram 47 to moving jaw 55. Arrow 57 in FIG. 4 illustrates a rotation of moving jaw 55 about pivot 56. Arrow 51 in FIG. 4 illustrates the cutting action of moving jaw 55 as it cuts through multiple casing layers or tubular members 43, 44, 45.

Figure 1:
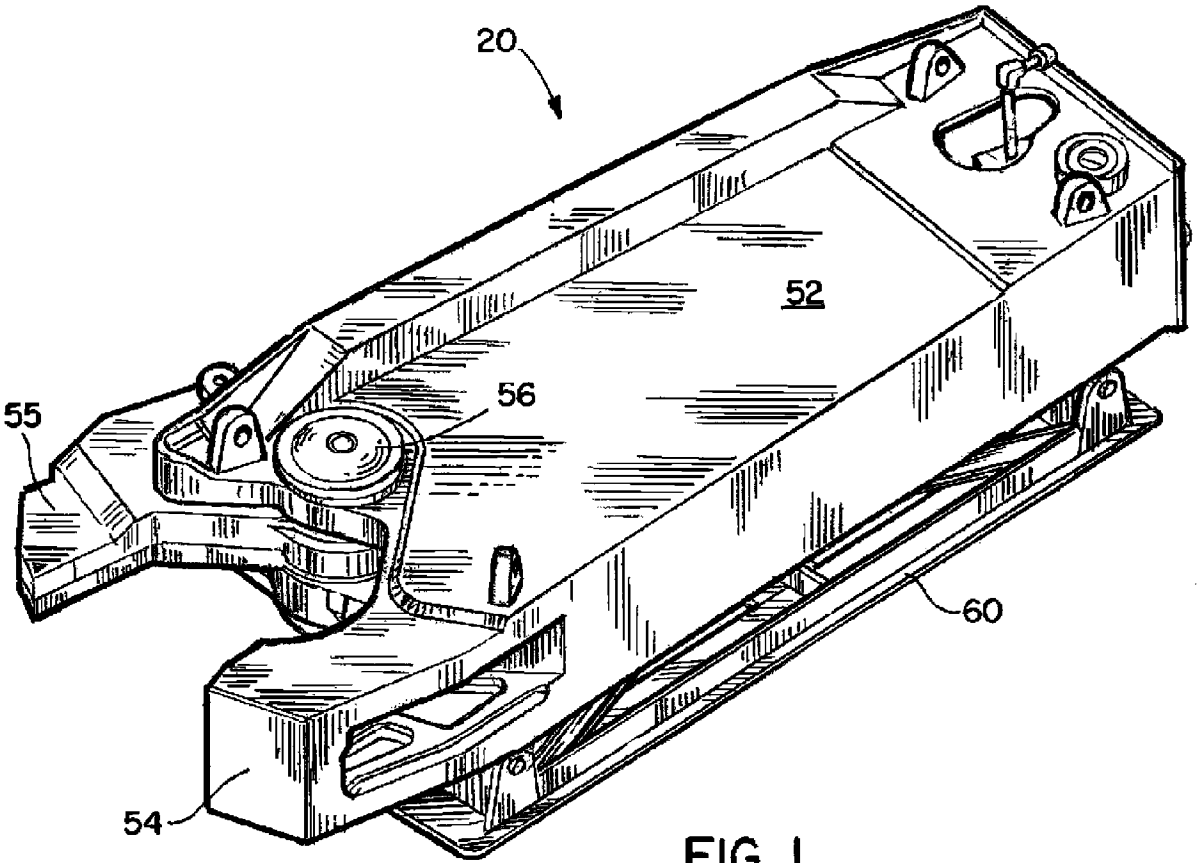
FIG. 1 is a partial perspective view of the preferred embodiment of the apparatus of the present invention and showing a shear that is used with the method of the present invention.
Figure 2:
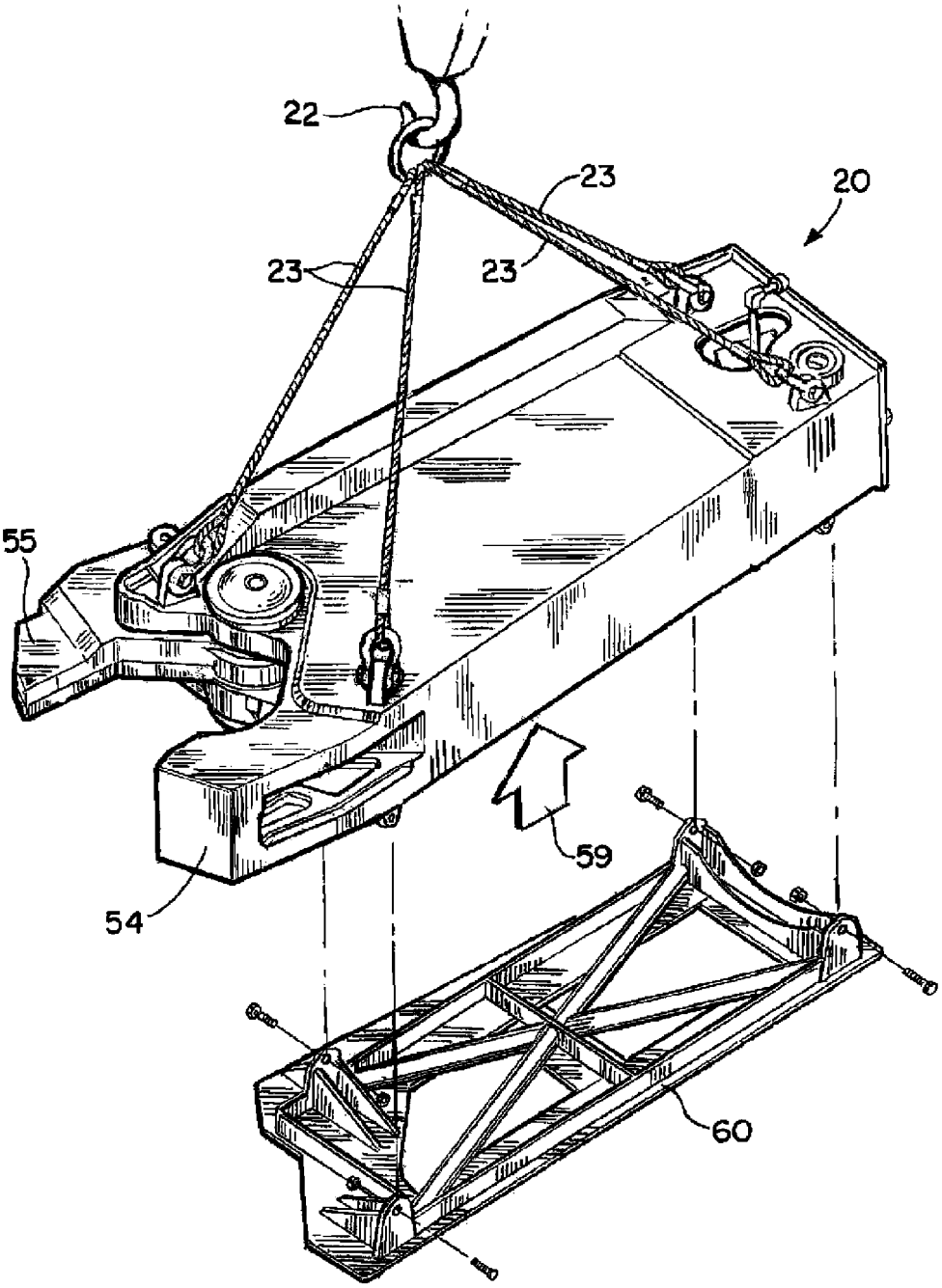
FIG. 2 is a partial perspective view of the preferred embodiment of the apparatus of the present invention and showing a shear that is used with the method of the present invention.

The ram 45 is connected housing 52 using a pinned connection at 53. Moving jaw 55 connects to housing 52 at pivotal connection 56. Either of the shear mechanisms 20, 41 can be provided with a cradle 60. Lifting arm 21 and hook 22 can be used to lift shear mechanism 20 or 41 from cradle 60 as illustrated by arrow 59 in FIG. 2.

The following is a list of parts and materials suitable for use in the present invention.

PARTS LIST

| Part Number | Description |
|---|---|
| 10 | oil well |
| 11 | platform |
| 12 | deck area |
| 13 | opening |
| 14 | well string |
| 15 | production tubing |
| 16 | lifting device |
| 17 | arrow |
| 18 | slips |
| 19 | handle |
| 20 | shear |
| 21 | lifting line |
| 22 | hook |
| 23 | rigging |
| 24 | hydraulic fluid line |
| 25 | hydraulic fluid line |
| 26 | cut |
| 27 | upper part |
| 28 | lower part |
| 29 | casing string |
| 30 | beams |
| 31 | beams |
| 32 | pin |
| 33 | drilled opening |
| 34a | drill |
| 35 | upper section |
| 36 | lower section |
| 37 | arrow |
| 38 | arrow |
| 39 | arrow |
| 40 | hydraulic power unit |
| 41 | shear |
| 42 | control panel |
| 43 | tubular member |
| 44 | tubular member |
| 45 | tubular member |
| 46 | concrete |
| 47 | ram |
| 48 | cylinder |
| 49 | pushrod |
| 50 | arrow |
| 51 | arrow |
| 52 | housing |
| 53 | connection |
| 54 | fixed jaw |
| 55 | moving jaw |
| 56 | pivot |
| 57 | arrow |
| 58 | connection |
| 59 | arrow |
| 60 | cradle |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of severing a well string that extends into an oil well from an oil platform with a deck, comprising the steps of:

a) supporting initial upper and initial lower sections of the well string;

b) providing a hydraulic shear mechanism;

c) lifting the shear mechanism to a position above the platform deck;

d) shearing the well string to form a cut in between the upper and lower sections;

e) removing the upper well string section above the cut;

f) lifting the lower section a selected distance so that the lower section below the cut now provides a second upper section and a second lower section;

g) repeating steps "a" through "f";

h) wherein step "a" comprises drilling an opening through the well string and inserting a pin through the drilled opening; and i) wherein the pin rests upon a pair of spaced apart beams in step "a".

2. The method of claim 1 wherein in step "d" the well string is production tubing.

3. The method of claim 1 wherein in step "d" the well string is casing.

4. The method of claim 3 wherein the casing includes multiple concentric casings.

5. The method of claim 4 wherein there is cement or concrete in between sections of casing.

6. The method of claim 1 wherein in step "a" slips support the well string at least in part.

7. A method of severing a well string that extends into an oil well from an oil platform with a deck, comprising the steps of:

a) supporting the well string at a first elevation;

b) providing a hydraulic shear mechanism;

c) placing the shear mechanism next to the platform deck;

d) shearing the well string near the deck with the shear mechanism to form a cut in the well string;

e) removing an upper, cut well string section above the cut;

f) after step "e" elevating the well string a selected distance;

g) repeating steps "c" through "f";

h) wherein step "a" comprises drilling an opening through the well string and inserting a pin through the drilled opening; and i) wherein the pin rests upon a pair of spaced apart beams in step "a".

8. The method of claim 7 wherein in step "d" the well string is production tubing.

9. The method of claim 7 wherein in step "d" the well string is casing.

10. The method of claim 9 wherein the casing includes multiple concentric casings.

11. The method of claim 10 wherein there is cementitious material in between sections of casing.

12. The method of claim 7 wherein in step "a" slips support the well string at least in part.

13. A method of severing a well string that extends into an oil well from an oil platform with a deck, comprising the steps of:

a) supporting the well string at a first elevation with a support that is positioned at the deck;

b) providing a hydraulic shear mechanism;

c) placing the shear mechanism next to the platform deck and above the support;

d) shearing the well string above the platform deck with the shear mechanism to form a cut in the well string;

e) removing an upper, cut well string section above the cut of step "d";

f) removing the support of step "a";

g) after step "f" elevating the well string a selected distance;

h) supporting the well string with the support at said elevated position;

i) repeating steps "c" through "h";

j) wherein in step "a" the support includes a pin, and the method includes drilling an opening through the well string and inserting the pin through the drilled opening; and k) wherein the pin rests upon a pair of spaced apart beams.

14. The method of claim 13 wherein in step "d" the well string is production tubing.

15. The method of claim 13 wherein in step "d" the well string is casing.

16. The method of claim 15 wherein the casing includes multiple concentric casings.

17. The method of claim 16 wherein there is cementitious material in between sections of casing.

18. The method of claim 13 wherein in step "a" the support includes slips that support the well string at least in part.

19. The method of claim 1, 7 or 13 wherein in step"d" the well string is a production casing.

* * * * *